US006588677B2

(12) United States Patent
Hofstetter, Sr. et al.

(10) Patent No.: US 6,588,677 B2
(45) Date of Patent: Jul. 8, 2003

(54) RAIL BOOT

(75) Inventors: Don R. Hofstetter, Sr., Montville, OH (US); Mark Grundmann, Arlington Heights, IL (US)

(73) Assignee: Iron Horse Engineering Co., Parkman, OH (US)

( * ) Notice: Subject to any disclaimer, the term of this patent is extended or adjusted under 35 U.S.C. 154(b) by 0 days.

(21) Appl. No.: 09/980,664

(22) PCT Filed: May 3, 2001

(86) PCT No.: PCT/US01/14335

§ 371 (c)(1),
(2), (4) Date: Nov. 2, 2001

(87) PCT Pub. No.: WO01/83889

PCT Pub. Date: Nov. 8, 2001

(65) Prior Publication Data

US 2003/0098359 A1 May 29, 2003

Related U.S. Application Data

(60) Provisional application No. 60/201,433, filed on May 3, 2000.

(51) Int. Cl.[7] ..... E01B 9/62

(52) U.S. Cl. ..... 238/283; 238/382; 238/336

(58) Field of Search ..... 238/2, 7, 8, 264, 238/283, 336, 382, 84, 3, 83, 91, 95, 96, 97, 122, 150; 264/271.15, 274.11, 173.17, 172.1

(56) References Cited

U.S. PATENT DOCUMENTS 4,609,144 A * 9/1986 Harmsen ..... 238/1
4,641,779 A * 2/1987 O'Brien et al. ..... 238/152
4,775,103 A * 10/1988 Ortwein ..... 238/149
5,165,598 A * 11/1992 Ortwein ..... 238/283
5,464,152 A * 11/1995 Wabnitz ..... 238/7
5,538,182 A * 7/1996 Davis et al. ..... 238/8
6,129,288 A * 10/2000 Petersen et al. ..... 238/8
6,174,477 B1 * 1/2001 Nagahashi et al. ..... 264/167
6,245,409 B1 * 6/2001 Cook ..... 428/122
6,270,017 B1 * 8/2001 Vennell ..... 238/1
6,296,195 B1 * 10/2001 Blank et al. ..... 238/2
6,354,512 B2 * 3/2002 Vennell ..... 238/2

FOREIGN PATENT DOCUMENTS

DE 3345388 A1 * 6/1986
DE 37 11 190 A1 10/1988
DE 42 24 082 A1 1/1994
EP 0 440 159 A1 8/1991

* cited by examiner

*Primary Examiner*—S. Joseph Morano
*Assistant Examiner*—Frantz F. Jules
(74) *Attorney, Agent, or Firm*—Pearne & Gordon LLP

(57) ABSTRACT

An insulating rail boot encasing a rail embedded in concrete, asphalt or paver construction, including, shared right-of-way, dedicated right-of-way and at-grade crossing. The rail and the rail boot are secured in place by retaining clips. The rail boot has two exposed top surfaces and a plurality of longitudinal cavities within the body of the boot. The top surfaces of the rail boot are sloped away from the rail and are coextruded with a multi-durometer material that is more rigid and tougher that the elastomer of which the boot is primarily constructed. An outside edge of each top rail boot surface is positioned flush with a surface of the road material. This cooperation between the top surfaces of the rail boot and the road surface facilitates flow of water and debris away from the rail.

8 Claims, 4 Drawing Sheets

RAIL BOOT

This application claims priority based on U.S. Provisional Application Ser. No. 60/201,433, filed May 3, 2000.

BACKGROUND OF THE INVENTION

This invention relates generally to electrically isolating a rail embedded in concrete, asphalt or paver construction, including shared right-of-way, dedicated right-of-way and at-grade crossings and more particularly to an elastomeric boot that partially encases such a rail.

DESCRIPTION OF THE RELATED ART

Due to the expansive presence of railway systems, rail beds must often cross a roadway or a pedestrian walkway at grade level or be built within the same roadway. At such intersections, the recessed areas of the rail bed are often built up so that the surface of the road or walkway is at the same level as the top surface of the rails, with the exception of the recesses provided adjacent to the rails to accommodate the rail car wheels.

To accomplish this type of shared right-of-way construction, the recessed areas on either side of the rails are often filled with road material, such as asphalt, poured concrete, or precast concrete structures. However, because the rails are often used as signal conductors or negative returns for the railcar's power traction and to inhibit the corrosion of the rails, they must be substantially electrically isolated from the ground. Further, it is beneficial to provide a flexible interface between the rail and the road material to allow for thermal expansion and contraction and mechanical loading and unloading of the rail itself. For this purpose, the rails are normally encased in some type of insulating material before the ground is filled with concrete or asphalt.

In some cases, a liquid settable elastomer is poured around the rails, such as disclosed in U.S. Pat. No. 4,449,666. However, this process can be very tedious and expensive. A more practical method of encasing the rails is to wrap them with a preformed elastomeric boot. Some examples of this method are shown in U.S. Pat. Nos. 4,641,779 and 5,464,152.

Existing designs for rail boots have proven to have some significant shortcomings. The soft, flexible nature of the elastomeric material is necessary for expansion, but is particularly susceptible to puncture damage by road traffic and by fasteners used to secure the rail at its base. Further, the boots may not bond particularly well to the surrounding road material and chasms may begin to open up at the interface. Additionally, when the rails are placed under a load by a train, the rails may flex and pull the boot away from the road surface. Moreover, even with preshaped boots, installation can be rather tedious, and may require that some type of tape or adhesive be used to secure the boot to the rail while the filling material is being poured or placed.

Elastomeric rail boots also serve to prevent the transfer of vibrations from the rails that can cause excessive noise and even damage the embedded track work or crossing structure. While existing designs tend to isolate the higher frequency vibrations, the solid elastomeric material tends to transfer the more pervasive low frequency vibrations to the surroundings.

SUMMARY OF THE INVENTION

The object of this invention is to provide a rail boot that can be used with a variety of different rail types in embedded track work that will maintain a close fit to both a rail and road materials during loading conditions.

The insulating rail boot encases a rail embedded in concrete, asphalt or paver construction, including, shared right-of-way, dedicated right-of-way and at-grade crossing. The rail and the rail boot are secured in place by retaining clips. The rail boot has two exposed top surfaces and a plurality of longitudinal cavities within the body of the boot. The top surfaces of the rail boot are sloped away from the rail. Top surfaces are designed to be a minimum of 1" wide to provide necessary relief from the adjacent paved surfaces and reduce the incidence of stray current leakage. An outside edge of each top rail boot surface is positioned flush with a surface of the road material. This cooperation between the top surfaces of the rail boot and the road surface facilitates flow of water and debris away from the rail.

It is one important aspect of this invention to provide a rail boot that is resistant to puncture by pneumatic and solid tire traffic and by rail fasteners.

In accordance with another aspect of this invention, it is further desirable to provide a rail boot that will mitigate the transfer of high frequency vibrations from the rail.

These and other aspects of this invention are illustrated in the accompanying drawings, and are more fully disclosed in the following specification.

DETAILED DESCRIPTION OF THE DRAWINGS

DETAILED DESCRIPTION OF THE PREFERRED EMBODIMENTS

Figure 2:
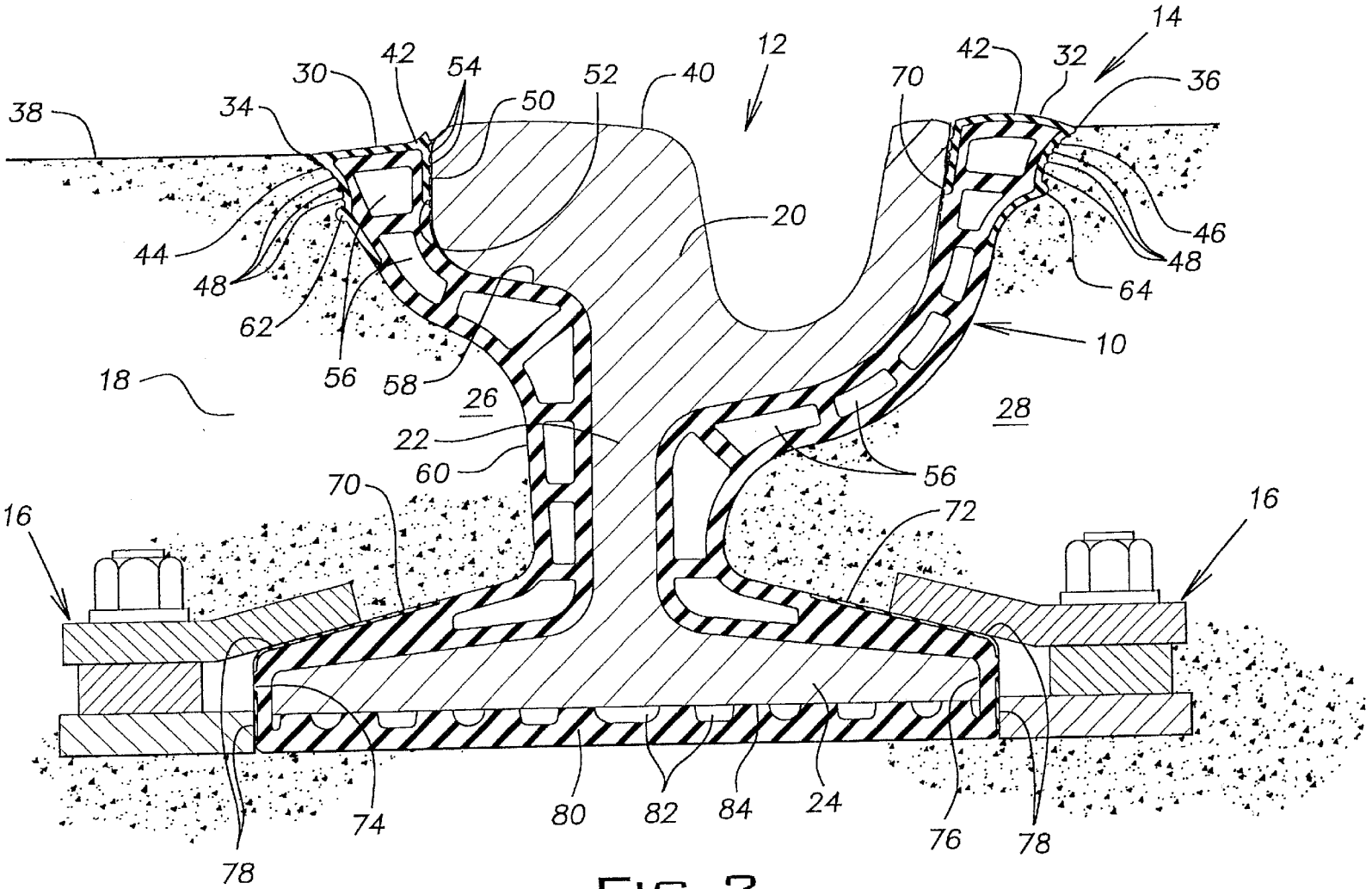
FIG. 2 is a section view of a rail enclosed by a rail boot of the present invention shown in cross section.

Referring now to FIG. 2, an insulating rail boot 10 is shown encasing a Ri 52 rail 12 as part of a shared right-of-way, dedicated right-of-way or at-grade crossing 14. The rail 12 shown in the drawings is for illustrative purposes as many types of rails may be used with rail boot 10. The rail 12 and the boot 10 are secured in place by retaining clips 16. The area around the boot 10 is filled with road material 18. The road material 18 may be concrete, asphalt or paver construction material.

Figure 1:
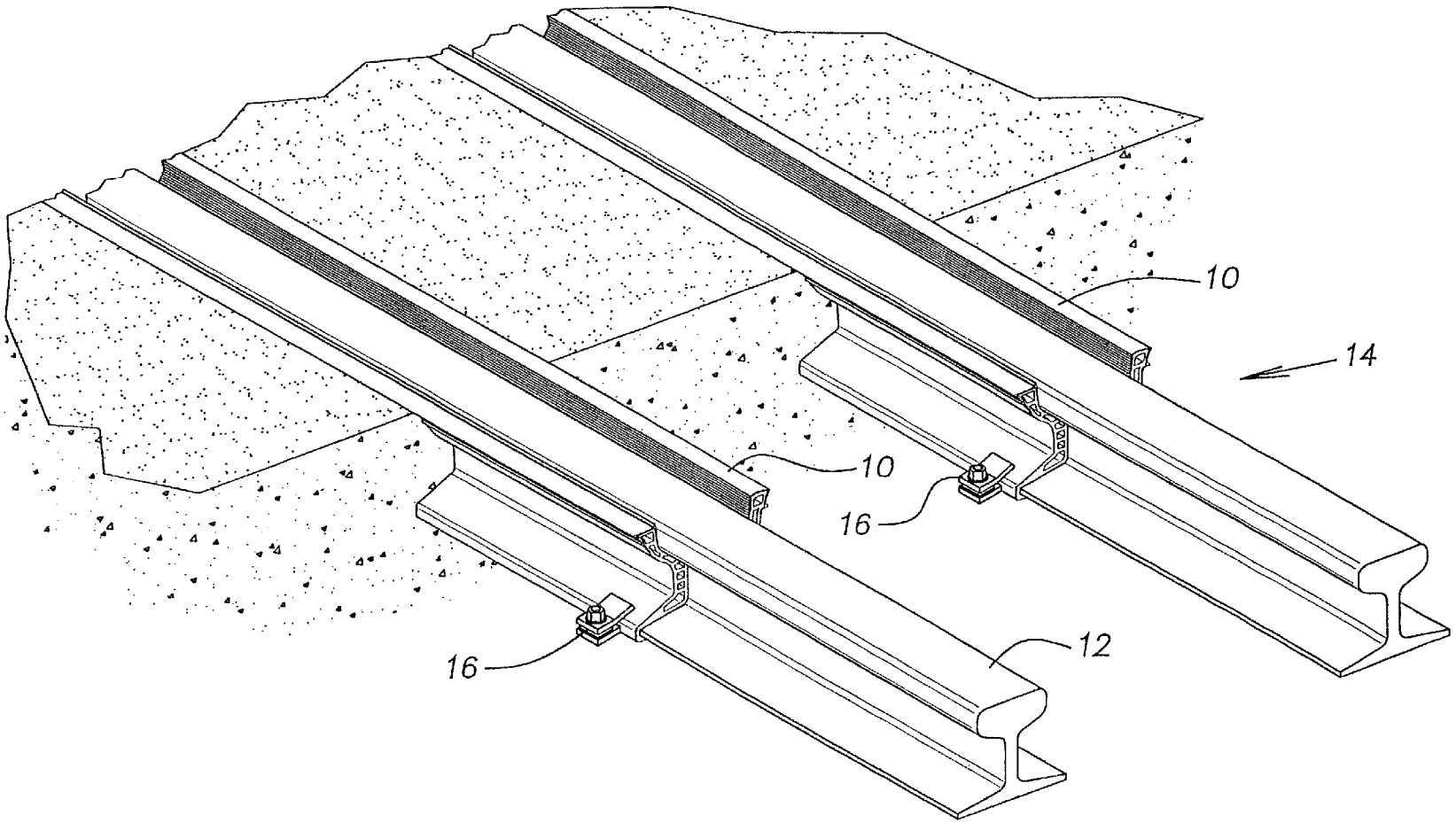
FIG. 1 is a perspective view of a rail system enclosed by a rail boot of the present invention.

As shown in FIG. 1, the boot 10 extends uniformly along the rail 12, having the same cross-sectional appearance throughout. The boot 10 is manufactured as a continuous piece from various elastomers being good electrical insulators. The boot 10 can easily be provided in any lengths required to minimize joints and extend as far as possible within the embedded track work or crossing 14, which varies among crossings.

The rail 12 is a standard type having a head or upper portion 20, a web or connecting central portion 22 and a flange or lower portion 24. The outside of the rail 12 will be referred to as the field side 26, being the left half of FIG. 2. The inside of the rail 12 will be referred to as the gauge side 28, being the right half of FIG. 2.

The rail boot 10 has two exposed top surfaces 30, 32. These surfaces are sloped away from the rail 12 and have a minimum clearance on each side of the head of the rail 12 of 1" (25 mm). Top surfaces are designed to be a minimum of 1" wide to provide necessary relief from the adjacent paved surfaces and reduce the incidence of stray current leakage. An outside edge 34, 36 of each top surface 30, 32 is positioned flush with a surface 38 of the road material 18. This cooperation between the top surfaces 30,32 and the road surface 38 facilitates flow of water and debris away from the rail 12 and to prevent build-up of ice and other material on a top surface 40 of the head 20.

Further, the top surfaces 30, 32 of the boot are formed with a "multi-durometer" material that is more rigid and tougher than the elastomer of which the boot 10 is primarily constructed. The multi-durometer material 42 helps to prevent the deformation and puncture of the top surfaces 30, 32 that may otherwise be caused by road traffic. Such deformation and puncture may prevent the rail boot 10 from effectively facilitating the run off of water and debris, and additionally it may compromise the overall integrity of the boot 10.

The multi-durometer material is coextruded onto the boot 10. Coextrusion is the process of extruding two or more materials through a single die with two or more orifices arranged so that the extrudates merge and weld together into a laminar structure before chilling. Each material is fed to the die from a separate extruder, but the orifices may be arranged so that each extruder supplies two or more plies of the same material. Coextrusion can be employed in film blowing, free film extrusion, and extrusion coating processes. The advantage of coextrusion is that each ply of the laminate imparts a desired characteristic property, such as stiffness, heat-sealability, impermeability or resistance to some environment, all of which properties would be impossible to attain with any single material.

Adjacent to the top surfaces 30, 32 are outside surfaces 44, 46 whose surfaces are also formed from the multi-durometer material 42. These outside surfaces provide an interface with the road material 18. The outside surfaces 44, 46 are provided with protrusions 48 to provide additional surface contact area with the asphalt or concrete road material 18 to promote bonding.

Also adjacent to the top surface 30 is an inside surface 50 of the rail boot 10 which interfaces with an outside surface 52 on the field side 26 of the rail 12. This inside surface so also comprises an extension of the multi-durometer material 42. The inside surface 50 is provided with protrusions 54 that promote the formation of a seal between the rail head 20 and the rail boot 10.

The rail boot 10 is provided with a plurality of longitudinal cavities 56 between an interior surface 58 and an exterior surface 60 of the rail boot 10. The plurality of longitudinal cavities extend from the underside head of the rail 12 to the top of the base of the rail 12. The cavities allow the exterior surface 60 to maintain good contact with the road material 18 and the interior surface 58 to stay in contact with the rail 12, even if the rail 12 and the road material 18 shift slightly with respect to each other. Such shifting may occur as a result of settling, passing road traffic and periodic loading of the rails by trains. The mechanical separation significantly limits or eliminates cracking produced by movement of the rail and isolates the rail 12 mechanically and provides two layers of protection from puncture or other incidental damage.

Additionally, to prevent the exterior surface 60 from flexing along with the interior surface 58 during rail movement due to train loading, latching knobs 62, 64 are provided on each of the outside surfaces 44, 46 of the rail boot 10.

Figure 4:
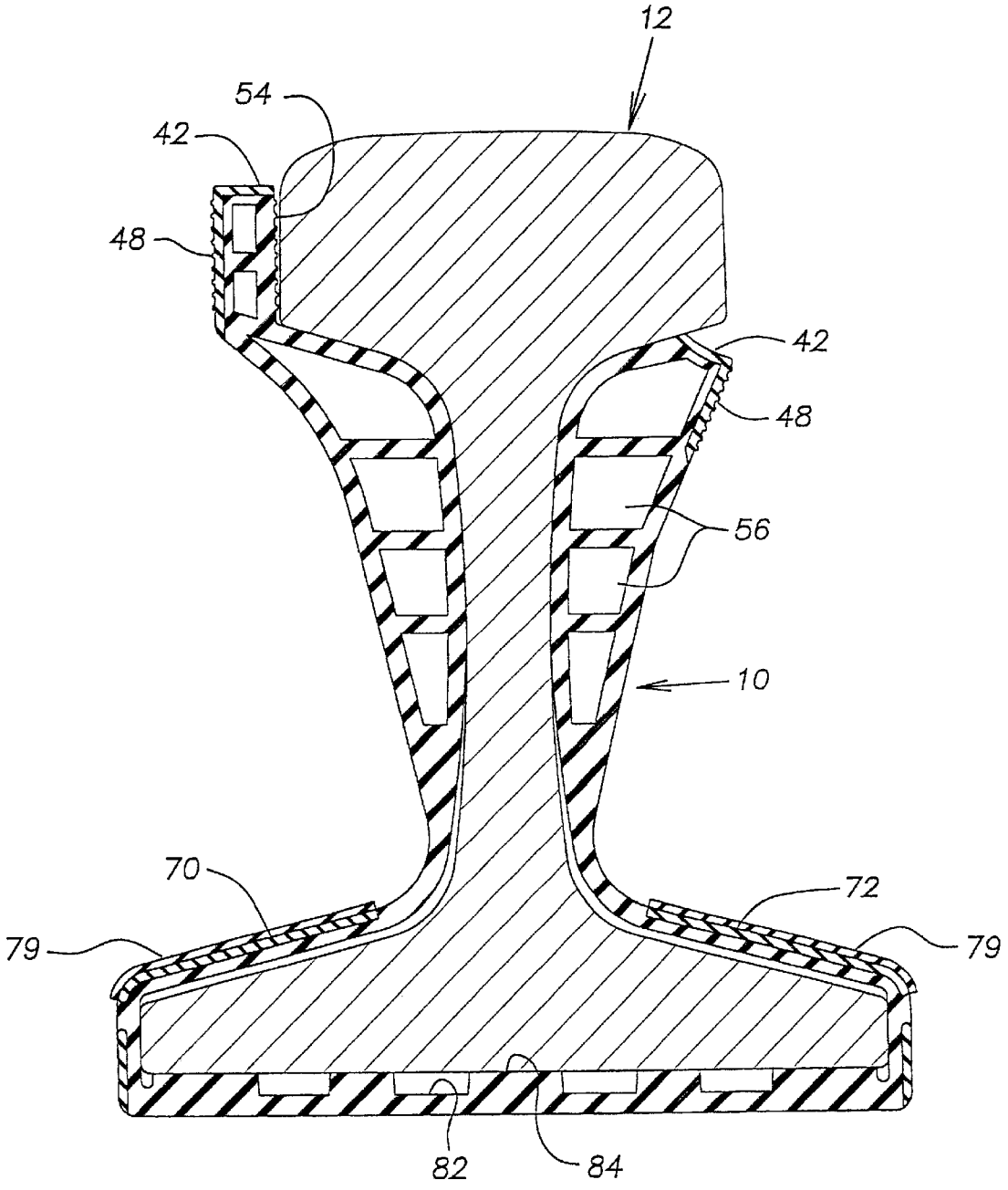
FIG. 4 is a section view of an alternate embodiment of a rail boot used with TRAM rail.

Top surfaces 70, 72 and outside surfaces 74, 76 of the rail boot 10 at the portion of the boot 10 that surrounds the rail flange 24 are provided with a bi-layered, multi-durometer material 78 similar to the multi-durometer material 42 of the top surfaces 30, 32. These surfaces 70, 72 are layered with a bi-layered, multi-durometer material 42. The extruded multi-durometer material 78 prevents the retaining clips 16 from puncturing or otherwise damaging the rail boot 10. As illustrated in FIG. 4, when nylon-reinforced plastic retaining clips (not shown) are used with rail boot 10, the top surfaces 70, 72 are coextruded with a two- or three-layered, multi-durometer material 79.

A bottom portion 80 of the rail boot 10 is provided with channels 82 that are adjacent to a bottom surface 84 of the rail flange 24. These channels 82 provide vertical movement for the rail boot 10 and, additionally reduce noise vibration transfer between the rail 12 and the supporting road material 18 or supporting railroad ties (not shown). The shapes of the channels 82 allow the rail 10 to flex vertically without transferring all of the low frequencies that are created while the rail cars are traveling on the rail.

Figure 3:
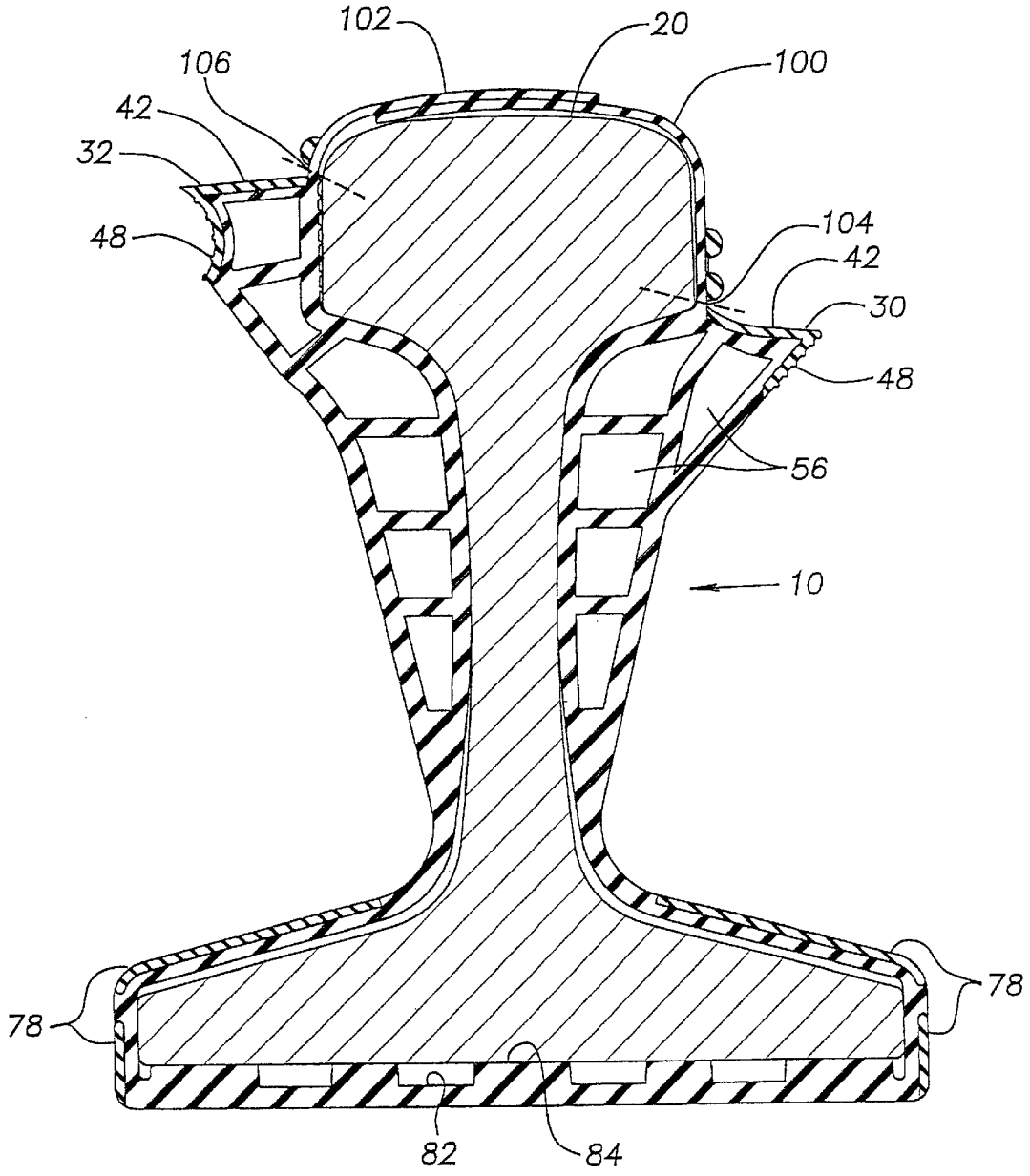
FIG. 3 is a section view of an alternate embodiment illustrating rail boot with sacrificial wings shown in cross section.

Referring now to FIG. 3, sacrificial wings 100, 102 are incorporated into the top of boot 10. The wings are used for temporary protection of the head of the rail 20 during the rail installation process. The wings are removed at or near the top surfaces 30, 32 at points 104, 106 as illustrated in FIG. 3. The wings once removed from boot 10 are discarded.

The alternative embodiments shown in FIGS. 3 and 4 are of the same construction as the embodiment shown in FIG. 2 and hence, the figures, portions or components shown in FIGS. 3 and 4 are designated by like reference characters to those in FIG. 2.

Although the invention has been shown and described with respect to certain embodiments, it is obvious that equivalent alterations and modifications will occur to others skilled in the art upon reading and understanding of the specification. The present invention includes all such equivalent alterations and modifications, and is limited only by the scope of the claims.

What is claimed is:

1. A rail boot for isolating an embedded rail having a head and a base, comprising:

a body having two exposed top surfaces, an inside surface, an outside surface and a bottom portion;

a plurality of longitudinal cavities between said inside and said outside surfaces of said body, said cavities extending within said body intermediate said head and said base of said embedded rail, and a pair of sacrificial wings extending from said body for covering said head for temporary protection of the head, said wings being removable after installation of said rail and boot.

2. A rail boot as set forth in claim 1, wherein said body is a coextrudate formed of at least first and second coextruded elastomeric materials, said first elastomeric material forming the bulk of said body and said second elastomeric material forming protective layers at specific locations on said body.

3. A rail boot as set forth in claim 2, wherein said first and second elastomeric materials are thermally bonded together at said specific locations as a coextrudate during coextrusion of said body.

4. A rail boot as set forth in claim 3, wherein said elastomeric materials have different durometer hardnesses, and said second elastomeric material is tougher and harder than said first elastomeric material.

5. A rail boot as set forth in claim 4, wherein said rail head has an upper surface and said boot has a generally U-shape cross-section for partially encasing said rail remote of said rail upper surface, said body including exposed top surfaces, inside surfaces for engaging said rail and outside surfaces spaced from said inside surfaces by a plurality of longitudinally extending cavities, and a bottom portion for receiving said base of said rail, said protective layers being located along at least one of said top, inside and outside surfaces of said body.

6. A rail boot for isolating an embedded rail having a rail head including an upper surface and a base extending along a rail length, said rail boot comprising a coextruded body formed of at least first and second coextruded elastomeric materials, said first elastomeric material forming the bulk of said body and said second elastomeric material forming protective layers at specific locations on said body, said first and second elastomeric materials being simultaneously coextruded and thermally bonded together at said specific locations as a coextrudate during coextrusion of said body, said elastomeric materials having different durometer hardnesses, said second elastomeric material being tougher and harder than said first elastomeric material, said boot having a generally U-shape unitary cross-section for partially encasing said rail remote of said rail upper surface and a length extending along said rail length to isolate said rail from surrounding embedment material, said body including exposed top surfaces, inside surfaces for engaging said rail and outside surfaces for engaging surrounding embedment material, said outside surfaces being spaced from said inside surfaces by a plurality of cavities extending along said length of said body, said protective layers being located along said top, inside and outside surfaces of said body.

7. A rail boot as set forth in claim 6, wherein said body also includes a bottom portion for receiving said base of said rail, said inside and outside surfaces also extending along said bottom portion, and said protective layers are located along said top surfaces of said body, said outside and inside surfaces of said body adjacent said rail head and said outside surfaces adjacent said bottom portion of said body.

8. A rail boot as set forth in claim 6, wherein said body also includes a bottom portion for receiving said base of said rail, said inside and outside surfaces also extending along said bottom portion, said bottom portion of said body includes generally horizontally and vertically extending portions, said outside surface of said body extends along said horizontally and vertically extending portions, and said protective layers are located along said horizontally and vertically extending portions of said outside surface adjacent said bottom portion of said body.

* * * * *